US005249588A

United States Patent [19]

Brown et al.

[11] Patent Number: 5,249,588

[45] Date of Patent: Oct. 5, 1993

[54] SMOKING ARTICLES

[75] Inventors: Ian C. Brown, Winchester; David J. Dittrich; Richard T. Fiebelkorn, both of Southampton, all of England

[73] Assignee: British-American Tobacco Company Limited, London, England

[21] Appl. No.: 799,673

[22] Filed: Nov. 21, 1991

Related U.S. Application Data

[63] Continuation of Ser. No. 497,866, Mar. 22, 1990, abandoned.

[30] Foreign Application Priority Data

Mar. 31, 1989 [GB] United Kingdom ..... 8907255

[51] Int. Cl.[5] ..... A24B 9/00; A24B 3/18

[52] U.S. Cl. ..... 131/291; 131/347; 131/352

[58] Field of Search ..... 131/291-296, 131/347, 352

[56] References Cited

U.S. PATENT DOCUMENTS

| | | | |
|---|---|---|---|
| 1,407,274 | 2/1922 | Hibbert | 131/352 |
| 3,385,303 | 5/1968 | Hind et al. | 131/352 |
| 4,034,766 | 7/1977 | Sanford | 131/352 |
| 4,310,006 | 1/1982 | Hibbits . | |
| 4,924,888 | 5/1990 | Perfetti et al. | 131/365 X |

*Primary Examiner*—V. Millin
*Assistant Examiner*—J. Doyle
*Attorney, Agent, or Firm*—Kane, Dalsimer, Sullivan, Kurucz, Levy, Eisele and Richard

[57] ABSTRACT

A smoking article which comprises tobacco treated with a high loading level of humectant and which has been expanded by a high level expansion process to produce expanded tobacco having a humectant loading level in the range of 4% to 15%. The particulate matter, water, nicotine and humectant free (PMWNHF) to nicotine delivery ratio of smoking articles according to the invention and smoked under standard machine smoking conditions is not more than 8 to 1.

10 Claims, No Drawings

SMOKING ARTICLES

BACKGROUND OF THE INVENTION

Cross Reference to Related Application

This application is a continuation of our co-pending U.S. patent application Ser. No. 497,866 filed on Mar. 22, 1990, and now abandoned.

FIELD OF THE INVENTION

The invention the subject of this application relates to cigarettes and similar smoking articles.

SUMMARY OF THE INVENTION

It is an object of the subject invention to provide a cigarette which is of a low tar delivery but which is sensorily acceptable to the smoker.

The subject invention provides a smoking article comprising a tobacco rod, which rod comprises cut tobacco and a paper wrapper circumscribing said tobacco, a major portion at least of said tobacco having been treated with a humectant to provide a loading level of said humectant of 4% to 15% by weight. Suitably, the loading level of the humectant on the tobacco is not less than 5% and does not exceed 12%. More suitably, the loading level is in the range of 7–10%, 9% for example.

DETAILED DESCRIPTION OF THE PREFERRED EMBODIMENTS OF THE INVENTION

The humectant is suitably one or more of glycerol, propylene glycol, sorbitol and diethylene glycol.

Advantageously, the humectant is applied to the tobacco prior to the tobacco being subjected to an expansion process. The loading level of the humectant on the tobacco prior to expansion may be in a range of about 5% to about 20% in order to result in a post expansion level of 4% to 15%.

We have found that if the humectant is applied to the tobacco before rather than after the tobacco is subjected to the expansion process, a reduction in tobacco strand length during the process is avoided. Further advantages of applying the humectant prior to expansion reside in the avoidance of an undesirably high equilibrium moisture content post expansion and the avoidance of a reduction in the filling power of the expanded tobacco.

Suitably, the humectant is applied to the tobacco by being sprayed thereon, advantageously in aqueous solution.

The humectant should, before the tobacco is subjected to the expansion process, be distributed of the tobacco with a significant degree of uniformity, which objective may be furthered by tumbling the tobacco and/or allowing the tobacco to stand in bulk for a sufficient time after the application of the humectant.

Tobacco of smoking articles according to the subject invention which is to be subjected to an expansion process is suitably pre-conditioned to a moisture content in a range of 22% to 30% and preferably to a moisture content in a range of 26% to 30%.

Tobacco of smoking articles according to the subject invention which is subjected to an expansion process may be lamina and/or stem tobacco. The expanded tobacco advantageously comprises a lamina tobacco the product of a tobacco expansion process which is effective to provide a high degree of expansion in tobacco subjected to the process. High expansion processes are disclosed, for example, in the specification of Reissue U.S. Pat. No. 30,693 and in United Kingdom Patent Specifications Nos. 1,570,270 and 2 160 408A. By use of high expansion processes, tobacco expansion values, in terms of filling value increase, of from about, typically, 75% and even up to about 125% may be obtained. Tobacco which has been subjected to a high expansion process may have a bulk density of, for example, from about 100 mg/cc to about 200 mg/cc, and preferably not less than 150 mg/cc, as measured using a Borgwaldt Densimeter.

A minor proportion of the smoking material of smoking articles according to the subject invention may take the form of reconstituted tobacco and/or tobacco substitute material. Preferably though, the smoking material should be wholly natural cut tobacco. It is also preferable that the whole or a substantial proportion of the cut tobacco of smoking articles according to the subject invention should be expanded tobacco and that the whole of this expanded tobacco should have been treated with humectant prior to being expanded. Suitably, at least 65% of the tobacco is treated expanded tobacco, and more suitably 70% is treated expanded tobacco.

The weight of the smoking material in a cigarette according to the subject invention is suitably in a range of 500 to 800 mg.

Suitably, the packing density of the smoking material of smoking articles according to the subject invention does not exceed 210 mg/cc.

It is to be observed that when measurement is made of the PMWNF delivery of a smoking article according to the subject invention, the value obtained includes a proportion of the humectant. It may thus be of interest to express particulate matter delivery on a water, nicotine and humectant free basis (PMWNHF). Preferably, the PMWNHF to nicotine delivery ratio of smoking articles according to the subject invention is not more than 8 to 1 and is preferably in the region of 6 to 1, and more preferably in the region of about 5 to 1.

The humectant in the mainstream smoke of cigarettes according to the subject invention, as measured under standard machine smoking conditions, preferably forms not less than 15%, and more preferably not less than 20%, of the mainstream PMWNF. Yet more preferably the mainstream smoke humectant forms approximately 25% of the mainstream PMWNF. Suitably, the mainstream smoke humectant may also be in the range 24% to 26%, 24% for example.

A burn retardant may be used in smoking articles in accordance with the subject invention. The burn retardant may be, for example, magnesium chloride, sodium chloride, ammonium sulphate, ammonium lactate, or mixtures thereof, applied to the smoking material.

According to a further aspect thereof, the subject invention provides a tobacco treatment comprising the application of a humectant to tobacco and, subsequent to said application, the expanding of said tobacco, the application level of said humectants to said tobacco before the expansion step being such that the loading level of said humectant after said tobacco has been expanded is in a range of 4% to 15% by weight.

In order to further the understanding of the subject invention, examples according thereto will now be described.

EXAMPLE I

To a cut tobacco blend comprising 20% water treated stem, 40% burley tobacco lamina and 40% flue cured tobacco lamina there was added glycerol at a 10% loading level and magnesium chloride at a 1% loading level. The blend was conditioned to 25% moisture content, the blend being thereafter subjected to a high level expansion process. The glycerol loading on the expanded tobacco was about 6%.

Using the thus obtained expanded tobacco, 24.75 mm circumference cigarettes were made. Each cigarette comprised a 64 mm long tobacco rod consisting of 100% of the expanded tobacco and of wrapper of a standard commercial cigarette paper. The packing density of the tobacco in the tobacco rods was about 145 mg/cc. To each of the tobacco rods there was attached, by a tipping wrapper, a 20 mm long cellulose acetate filter plug. The cigarettes were laser ventilated at the filters to provide a ventilation value of 55%.

These cigarettes were smoked under standard (Coresta) machine smoking conditions according to which a 35 $cm^3$ puff of two seconds duration is taken every minute and were found to yield mainstream smoke component deliveries as follows.

| Component | Delivery (mg) |
|---|---|
| TPM | 5.88 |
| Nicotine | 0.63 |
| PMWNF | 4.37 |
| Glycerol | 1.35 |
| PMWNHF | 3.02 |

It is thus to be observed that the PMWNHF to nicotine ratio was 4.8. It may also be observed that the glycerol delivery represented 31% of the PMWNF delivery.

It was found that when smoked under Coresta machine smoking conditions, a commercially available cigarette, Benson & Hedges Ultra (Trade Mark), of similar delivery, i.e. 5.57 mg TPM, had a mainstream glycerol delivery of 0.44 mg, this representing 9.4 per cent of the PMWNF delivery. The PMWNHF to nicotine ratio of the Ultra cigarettes was 9.9.

In sensory panel smoking tests it was found that the above detailed cigarettes according to the subject invention exhibited sensory features superior to those of the Ultra cigarettes.

EXAMPLE II

To a first cut tobacco blend comprising 65% flue cured lamina and 35% burley lamina was added glycerol at a 6% loading level and ammonium lactate at a 2% loading level. The blend was conditioned to a 30% moisture content, the blend being thereafter subjected to the high level DIET expansion process. The glycerol loading level on the expanded tobacco was 4.4%.

A second cut tobacco blend comprised 50% burley lamina and 50% sun cured oriental lamina. The second blend was not subjected to an expansion process.

The first and second blends were combined in the proportions 70% first to 30% second and to the thus obtained combined blend was added propylene glycol at a 1.5% loading level. Thus the total loading level of humectant, glycerol plus propylene glycol, was 4.6%.

Using the tobacco of the combined . blend 24.75 mm circumference cigarettes were made. Each cigarette comprised a 59 mm long tobacco rod and a standard commercial cigarette paper. The packing density of the tobacco in the rods was 190 mg/cc. To each of the rods there was attached a 25 mm long dual filter comprising a 7 mm long section of crimped paper and an 18 mm long section of cellulose acetate filtration material. The cigarettes were laser ventilated at the cellulose acetate sections of the filters to provide a ventilation of 60%.

When smoked under standard machine smoking conditions, mainstream smoke component deliveries were found to be as follows:

| Component | Delivery (mg) |
|---|---|
| TPM | 6.79 |
| Nicotine | 0.84 |
| PMWNF | 5.43 |
| Glycerol | 1.00 |
| Propylene glycol | 0.28 |
| PMWNHF | 4.15 |

Thus the PMWNHF to nicotine ratio was 4.9 and humectant represented 24% of the PMWNF delivery.

A commercially available cigarette of similar delivery, namely Camel Lights (Trade Mark), was found to have a mainstream glycerol delivery of 0.39 mg, this representing 8% of the PMWNF delivery. The PMWNHF to nicotine ratio of Camel Lights was 9.7.

EXAMPLE III

A cut tobacco blend comprised 25% burley lamina, 40% flue cured lamina, 25% water treated stem and 10% sun cured oriental lamina. To this blend was added glycerol at a 10% loading level and magnesium chloride at a 1% loading level. The blend was thereafter subjected to a high level expansion process. The glycerol loading level on the expanded tobacco was 8%.

Using the thus obtained tobacco cigarettes were made which were to the same format as the cigarettes according to the invention of Example I. When smoked under standard machine smoking conditions, mainstream smoke component deliveries were found to be as follows:

| Component | Delivery (mg) |
|---|---|
| TPM | 6.55 |
| Nicotine | 0.54 |
| PMWNF | 4.93 |
| Glycerol | 1.63 |
| PMWNHF | 3.30 |

Thus the PMWNHF to nicotine ratio was 6.1 and the humectant represented 33% of the PMWNF.

We claim:

1. A smoking article comprising a tobacco rod, which rod comprises cut expanded tobacco and a paper wrapper circumscribing said tobacco, a major portion at least of said tobacco having a loading level of humectant of 4% to 15% by weight of said tobacco, the packing density of said tobacco rod not exceeding 210 mg/cc, and wherein, when said article is smoked under standard machine smoking conditions, the particulate matter delivery on a water, nicotine and humectant free basis to nicotine delivery ration is not more than 6 to 1.

2. A smoking article according to claim 1, wherein the loading level of the humectant on the tobacco is not less than 5%.

3. A smoking article according to claim 2, wherein said loading level is not less than 7%.

4. A smoking article according to claim 1, wherein said loading level does not exceed 12%.

5. A smoking article according to claim 4, wherein said loading level does not exceed 10%.

6. A smoking article according to claim 1, wherein the humectant is one or more of glycerol, propylene glycol, sorbitol and diethylene glycol.

7. A smoking article according to claim 1, wherein the bulk density of said tobacco which has been expanded is from about 100 mg/cc to about 200 mg/cc.

8. A smoking article according to claim 1, wherein at least 65% of said tobacco of said rod is expanded tobacco treated with said humectant.

9. A smoking article according to claim 1, wherein, when said article is smoked under standard machine smoking conditions, the humectant in the mainstream smoke forms not less than 15% of the particulate matter on a water and nicotine free basis (PMWNF).

10. A smoking article according to claim 9, wherein the humectant in the mainstream smoke forms not less than 20% of the PMWNF.

* * * * *